US009188921B2

(12) United States Patent
Fukai

(10) Patent No.: US 9,188,921 B2
(45) Date of Patent: Nov. 17, 2015

(54) IMAGE FORMING APPARATUS WITH A FIXING DEVICE

(71) Applicant: Konica Minolta, Inc., Tokyo (JP)

(72) Inventor: Shougo Fukai, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/463,098

(22) Filed: Aug. 19, 2014

(65) Prior Publication Data

US 2015/0063846 A1 Mar. 5, 2015

(30) Foreign Application Priority Data

Sep. 5, 2013 (JP) ..... 2013-184091

(51) Int. Cl.
*G03G 15/20* (2006.01)
*G03G 15/00* (2006.01)

(52) U.S. Cl.
CPC ..... *G03G 15/2085* (2013.01); *G03G 15/2067* (2013.01); *G03G 15/5029* (2013.01); *G03G 15/2032* (2013.01); *G03G 2215/00223* (2013.01)

(58) Field of Classification Search
CPC ..... G03G 2215/2035; G03G 15/2064; G03G 15/2032; G03G 15/2067; G03G 2215/2022
USPC ..... 399/329, 331, 338
See application file for complete search history.

(56) References Cited

U.S. PATENT DOCUMENTS

| | | | | |
|---|---|---|---|---|
| 8,503,898 | B2 * | 8/2013 | Okamoto | 399/67 |
| 2008/0054553 | A1 * | 3/2008 | Muneyasu et al. | 271/240 |
| 2009/0245896 | A1 * | 10/2009 | Ishikake et al. | 399/328 |
| 2010/0158553 | A1 * | 6/2010 | Ueno | 399/67 |
| 2014/0086598 | A1 * | 3/2014 | Kawanago et al. | 399/16 |

FOREIGN PATENT DOCUMENTS

| | | |
|---|---|---|
| JP | 2005-300642 | 10/2005 |
| JP | 2006-091224 | 4/2006 |
| JP | 2012-155240 A | 8/2012 |
| JP | 2012-189688 | 10/2012 |
| JP | 2012-255901 | 12/2012 |
| JP | 2013-088517 | 5/2013 |

OTHER PUBLICATIONS

Office Action dated Sep. 8, 2015 issued by the corresponding Japanese patent application No. 2013-184091.
English translation of Office Action dated Sep. 8, 2015 issued by the corresponding Japanese patent application No. 2013-184091.

* cited by examiner

*Primary Examiner* — Francis Gray
(74) *Attorney, Agent, or Firm* — Lucas & Mercanti, LLP

(57) ABSTRACT

An image forming apparatus includes a paper feed unit, an image forming unit, a fixing unit, a conveyance unit, a control unit, a movement unit and an actuator. The fixing unit includes sandwiching members between which paper is sandwiched. The paper has a toner image thereon formed by the image forming unit. The sandwiching members form a nip part, and the fixing unit fixes the toner image to the paper at the nip part. When an execution condition is satisfied, the control unit performs first control under which the actuator releases a sandwiching pressure made by the sandwiching members and thereafter the movement unit moves the sandwiching members along a paper width direction which is at right angles to a conveyance direction of the paper.

9 Claims, 6 Drawing Sheets

IMAGE FORMING APPARATUS WITH A FIXING DEVICE

FIELD OF THE INVENTION

The present invention relates to an image forming apparatus provided with a fixing device.

DESCRIPTION OF THE RELATED ART

Ina conventional image forming apparatus which performs image formation by transferring toner images to paper, unfixed toner images on paper are fixed to the paper by pressure and heat at a nip part formed by sandwiching members, such as a roller and a belt, of a fixing unit, by making the paper having the unfixed toner images thereon pass through the nip part.

This kind of fixing device has a possibility that when image formation is performed on paper of the same size, at the nip part, traces of the end parts of the paper in the paper width direction are left and/or scratches are generated with the end parts on the surfaces of the sandwiching members, and these traces and/or scratches affect the pressurization and the heating for the fixation and accordingly cause degradation in image quality of formed images.

The fixing device also has a possibility that when image formation is performed on paper made of a seal material having an adhesive face to which glue is applied and which is covered with a sheet, the overflowed glue from the seal material adheres to and soils the nip part of the fixing device. When such dirt is built up at the same points on the sandwiching members, and larger paper passes through the points, the dirt adheres to the surface of the paper and accordingly causes degradation in image quality of formed images.

Then, as described in, for example, Japanese Patent Application Laid-Open Publication No. 2012-155240, a conventional image forming apparatus performs control to move sandwiching members, which constitute a nip part, in a direction at right angles to a conveyance direction of paper between a piece of paper and another piece of the paper so as to change points (passing points) where the end parts of the paper in the paper width direction pass on the surfaces of the sandwiching members of a fixing device, whereby the end parts do not keep passing through the same points thereon.

However, because the fixing device described in Japanese Patent Application Laid-Open Publication No. 2012-155240 moves rollers of the fixing device between apiece of paper and another piece of the paper, in the case where continuous paper such as rolled paper or continuous form paper (i.e. continuous stationary) is fed, the paper may be dragged thereby and damaged, and therefore the passing points cannot be changed.

BRIEF SUMMARY OF THE INVENTION

Objects of the present invention include providing an image forming apparatus which effectively prevents scratches and indentations from being generated on sandwiching members of a fixing device in the case where image formation is performed on continuous paper.

In order to achieve at least one of the above described objects, according to an aspect of the present invention, there is provided an image forming apparatus including: a paper feed unit which feeds paper; an image forming unit which forms a toner image on the paper; a fixing unit including sandwiching members between which the paper is sandwiched and which form a nip part, the fixing unit fixing the toner image to the paper at the nip part; a conveyance unit which conveys the paper along a conveyance path which passes through the image forming unit and the fixing unit; a control unit which controls an action of the image forming apparatus; a movement unit which moves the sandwiching members along a paper width direction which is at right angles to a conveyance direction of the paper; and an actuator which releases a sandwiching pressure made by the sandwiching members, wherein when an execution condition is satisfied, the control unit performs first control under which the actuator releases the sandwiching pressure and thereafter the movement unit moves the sandwiching members along the paper width direction.

Preferably, in the above image forming apparatus, the control unit performs second control under which the conveyance unit stops conveying the paper to the fixing unit so as to perform the first control.

Preferably, in the above image forming apparatus, the control unit performs third control under which the conveyance unit conveys the paper to the fixing unit at a conveyance speed lower than a standard conveyance speed so as to perform the first control.

Preferably, in the above image forming apparatus, the execution condition is that an amount of the paper passing through the nip part reaches a predetermined value, and each time the execution condition is satisfied, the control unit performs the first control.

Preferably, in the above image forming apparatus, the execution condition is that a length of time taken for the paper to pass through the nip part reaches a predetermined value, and each time the execution condition is satisfied, the control unit performs the first control.

Preferably, the above image forming apparatus further includes a first obtaining unit which obtains thickness information indicating thickness of the paper, wherein as the thickness indicated by the thickness information increases, the control unit increases a frequency of the first control.

Preferably, the above image forming apparatus further includes a second obtaining unit which obtains hardness information indicating hardness of the paper, wherein as the hardness indicated by the hardness information increases, the control unit increases a frequency of the first control.

Preferably, in the above image forming apparatus, the execution condition is that a stopping factor for the conveyance unit to stop conveying the paper occurs, and when the execution condition is satisfied, the control unit performs the first condition.

Preferably, the above image forming apparatus further includes a paper sensor which detects a position of an end part of the paper in the paper width direction in relation to the sandwiching members, the paper passing through the fixing unit, wherein the control unit stores a history of the position of the end part detected by the paper sensor since the first control performed last time, and performs the first control again in such a way as to avoid a point on each of the sandwiching members, the point where the end part of the paper has most frequently passed according to the history.

BRIEF DESCRIPTION OF THE SEVERAL VIEWS OF THE DRAWING

The present invention is fully understood from the detailed description given hereinafter and the accompanying drawings, which are given byway of illustration only and thus are not intended to limit the present invention, wherein.

DETAILED DESCRIPTION OF THE INVENTION

First Embodiment

Hereinafter, an image forming apparatus 1 is described as a first embodiment of the present invention with reference to the drawings. The present invention is not limited to the illustrated examples.

[Overview of Configuration of Image Forming Apparatus]

Figure 1:
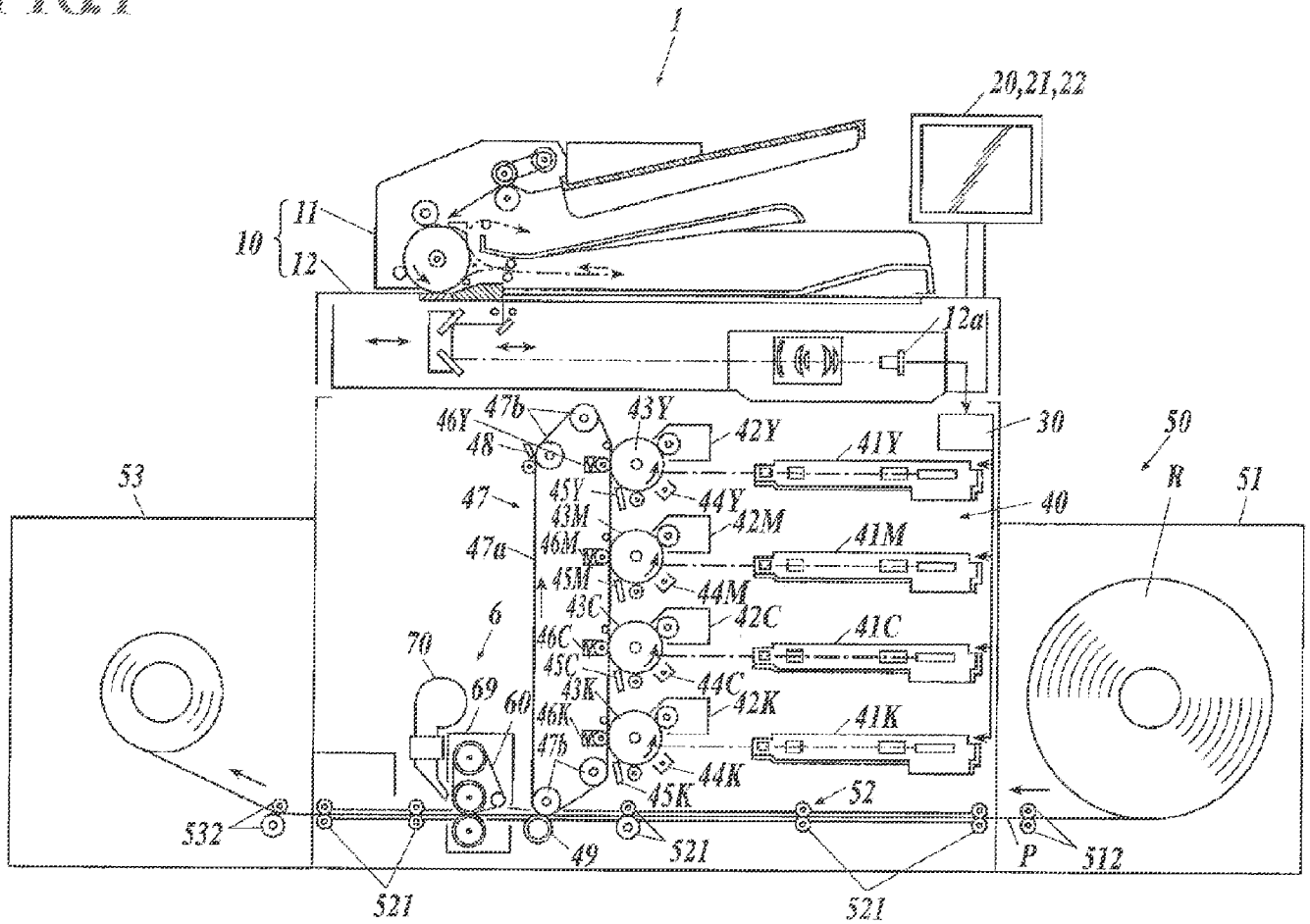
FIG. 1 is a cross-sectional view showing the overall configuration of an image forming apparatus including a fixing device according to a first embodiment of the present invention.
Figure 2:
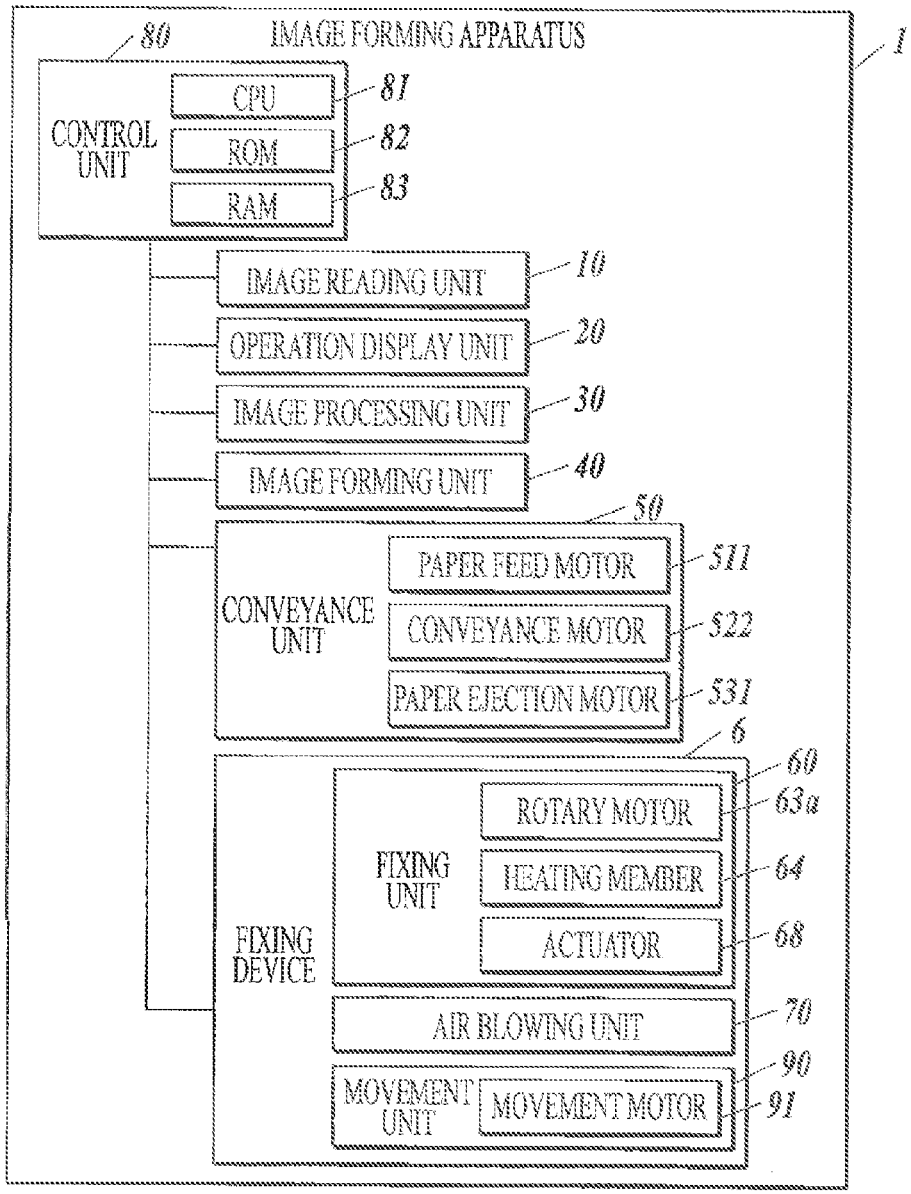
FIG. 2 is a block diagram showing the functional configuration of the image forming apparatus including the fixing device.

First, the configuration of the image forming apparatus 1 of the present invention is described with reference to FIGS. 1 and 2. FIG. 1 is a cross-sectional view showing the overall configuration of the image forming apparatus 1. FIG. 2 is a block diagram showing the functional configuration of the image forming apparatus 1.

The image forming apparatus 1 shown in FIGS. 1 and 2 forms an image by superposing colors on paper P on the basis of image data obtained by reading a color image formed on a document or image data input from an external information device (for example, a personal computer) via a network. The image forming apparatus 1 is a tandem image forming apparatus in which photosensitive drums 43Y, 43M, 43C and 43K for yellow (Y), magenta (M), cyan (C) and black (K) of four colors are arranged in series along a movement direction of a transferred body (an intermediate transfer belt 47*a* in the image forming apparatus 1) and Y, M, C and Y toner images are successively transferred to the transferred body by one procedure.

As shown in FIGS. 1 and 2, the image forming apparatus 1 includes an image reading unit 10, an operation display unit 20, an image processing unit 30, an image forming unit 40, a conveyance unit 50, a fixing device 6 and a control unit 80.

[Control Unit]

The control unit 80 includes a CPU (Central Processing Unit) 81, a ROM (Read Only Memory) 82 and a RAM (Random Access Memory) 83. The CPU 81 reads a program corresponding to a processing content from the ROM 82, opens the read program on the RAM 83 and performs centralized control on actions of the blocks (the image reading unit 10, the operation display unit 20, the image processing unit 30, the image forming unit 40, the conveyance unit 50, the fixing device 6, etc.) of the image forming apparatus 1 by working together with the opened program. At the time, the CPU 81 refers to various data stored in a storage unit (not shown). The storage unit is composed of, for example, a nonvolatile semiconductor memory (so-called flash memory) or a hard disk drive.

The control unit 80 transmits/receives various data to/from an external device (a personal computer, for example) connected to a communication network such as a LAN (Local Area Network) or a WAN (Wide Area Network) via a communication unit (not shown). The communication unit is composed of, for example, a communication control card, such as a LAN card.

[Image Reading Unit]

The image reading unit 10 includes an automatic document feed device 11 called an ADF (Auto Document Feeder) and a document image scanning device (scanner) 12.

The automatic document feed device 11 conveys and sends out a document placed on a document tray with a conveyance mechanism to the document image scanning device 12. The automatic document feed device 11 can continuously read images formed on a large number of documents (both sides thereof included) placed on the document tray in one action.

The document image scanning device 12 optically scans a document conveyed from the automatic document feed device 11 onto a contact glass or a document placed on the contact glass, and forms an image on a light receiving face of a CCD (Charge Coupled Device) sensor 12*a* with reflected light from the document, thereby reading an image formed on the document. On the image (analog image signals) read by the image reading unit 10, the image processing unit 30 performs predetermined image processing.

[Operation Display Unit]

The operation display unit 20 is composed of, for example, a liquid crystal display (LCD) provided with a touch panel, and functions as a display unit 21 and an operation unit 22. The display unit 21 displays thereon, for example, various operation screens, conditions of images and operating statuses of functions in response to display control signals input from the control unit 80. The operation unit 22 includes a numeric keypad and various operation keys such as a start key, and receives various input operations made by a user and outputs operation signals to the control unit 80.

Using the operation unit 22, a user inputs width, thickness information and hardness information about paper P which is rolled paper housed in a paper feed device 51 described below. The thickness information is information to determine into which of three levels of thickness categories, "thick paper", "plain paper" and "thin paper", the paper P falls. The hardness information is information to determine into which of three levels of hardness categories, "hard", "medium" and "soft", the paper P falls.

For example, when a user inputs the thickness of paper P housed in the paper feed device 51 in a numerical value as the thickness information, the control unit 80 determines into which of ranges respectively predetermined for "thick paper", "plain paper" and "thin paper", the numerical value falls, thereby identifying the thickness of the paper P housed in the paper feed device 51. Alternatively, it is possible that a user selects "thick paper", "plain paper" or "thin paper" and inputs the selected one as the thickness information about paper P housed in the paper feed device 51.

Similarity, when a user inputs one of "hard", "medium" and "soft" about paper P housed in the paper feed device 51 as the hardness information, the control unit 80 stores in the storage unit thereof that the paper P housed in the paper feed device 51 is "hard", "medium" or "soft", which the user inputs. Alternatively, it is possible that a user inputs the hardness of paper P housed in the paper feed device 51 in a numerical value as the hardness information, and the control unit 80 determines into which of ranges respectively predetermined for "hard", "medium" and "soft", the numerical value falls, thereby identifying the hardness of the paper P housed in the paper feed device 51.

The input width, thickness information and hardness information about paper P housed in the paper feed device 51 are stored in the storage unit of the control unit 80 as setting information.

Thus, the operation unit 22 functions as a first obtaining unit (for thickness) and a second obtaining unit (for hardness).

[Image Processing Unit]

The image processing unit 30 includes a circuit for analog-digital (A/D) conversion processing and a circuit for digital image processing. The image processing unit 30 performs A/D conversion processing on analog image signals input from the image reading unit 10, thereby generating digital image data (RGB signals). The image processing unit 30 also performs, for example, color conversion processing, correction processing (shading correction or the like) based on a default setting or a user setting and/or compression processing on the digital image data. The image forming unit 40 is controlled on the basis of the digital image data (YMCK signals) subjected to these types of processing.

[Image Forming Unit]

The image forming unit 40 includes exposure devices 41Y, 41M, 41C and 41K, developer devices 42Y, 42M, 42C and 42K, photosensitive drums 43Y, 43M, 43C and 43K, charger devices 44Y, 44M, 44C and 44K, cleaner devices 45Y, 45M, 45C and 45K and primary transfer rollers 46Y, 46M, 46C and 46K, which are provided for different color components of Y, M, C and K, and an intermediate transfer unit 47.

In the unit for Y component of the image forming unit 40, the charger device 44Y charges the photosensitive drum 43Y; the exposure device 41Y is composed of, for example, a semiconductor laser and emits laser light for Y component to the photosensitive drum 43Y, thereby forming a latent image of Y component on the surface of the photosensitive drum 43Y; and the developer device 42Y houses therein an developer agent of Y component (for example, a two-component developer agent composed of toner having a small grain diameter and a magnetic substance) and makes the toner of Y component adhere to the surface of the photosensitive drum 43Y, thereby developing the latent image (forming a Y toner image). Similarly, in the units for M, C and K components, M, C and K toner images are formed on the surfaces of the photosensitive drums 43M, 43C and 43K, respectively.

The intermediate transfer unit 47 is configured in such a way that the endless intermediate transfer belt 47*a* as the transferred body is stretched around a plurality of support rollers 47*b*. When the intermediate transfer belt 47*a* contacts the photosensitive drums 43Y, 43M, 43C and 43K by pressure of the primary transfer rollers 46Y, 46M, 46C and 46K, Y, M, C and K toner images are successively primary-transferred to the intermediate transfer belt 47*a* so as to be superposed on top of each other. When the intermediate transfer belt 47*a* to which Y, M, C and K toner images are primary-transferred contacts paper P by pressure of a secondary transfer roller 49, the color toner image (composed of the Y, M, C and K toner images) is secondary-transformed to the paper P.

The cleaner devices 45Y, 45M, 45C and 45K remove the remaining toners on the surfaces of the photosensitive drums 43Y, 43M, 43C and 43K after the primary transfer. A cleaner device 48 removes the remaining toners on the intermediate transfer belt 47*a* after the secondary transfer.

[Conveyance Unit 50]

The conveyance unit 50 includes the paper feed device 51, a conveyance mechanism 52 and a paper ejection device 53 as shown in FIGS. 1 and 2. The paper feed device 51 includes a paper feed motor 511, a pair of paper feed rollers 512 and a motor as a driving source for the paper feed rollers 512. The paper feed motor 511 supports a roll R composed of continuous paper P being rolled up, and lets out the paper P therefrom. The paper feed rollers 512 send out the paper P which is let out from the roll R to conveyance rollers 521 of the conveyance mechanism 52.

The paper ejection device 53 includes a paper ejection motor 531, a pair of rolling-up rollers 532 and a motor as a driving source for the rolling-up rollers 532. The paper ejection motor 531 rolls up the paper P subjected to image formation. The rolling-up rollers 532 take in the paper P subjected to image formation from the conveyance mechanism 52.

The control unit 80 controls speeds of the paper feed motor 511 and the paper ejection motor 531 in such a way that paper P is conveyed at a constant speed on the conveyance mechanism 52.

The conveyance mechanism 52 is composed of a conveyance path leading from the paper feed device 51 as a paper feed unit to the paper ejection device 53, pairs of conveyance rollers 521 disposed at some points on the conveyance path and a conveyance motor as a driving source for the conveyance rollers 521.

On the ends of the paper feed side and the paper ejection side of the conveyance mechanism 52, not-shown guides are disposed so as to guide the end parts of paper P in the paper width direction at their predetermined positions in the paper width direction, thereby preventing the paper P from being displaced in the paper width direction. The paper width direction is a direction along the surface of paper P and at right angles to a conveyance direction of the paper P.

To one side of paper P conveyed on the conveyance mechanism 52, color toner images on the intermediate transfer belt 47*a* are successively secondary-transferred in the image forming unit 40 and then fixed in the fixing device 6.

[Fixing Device: Overview of Configuration]

Figure 3:
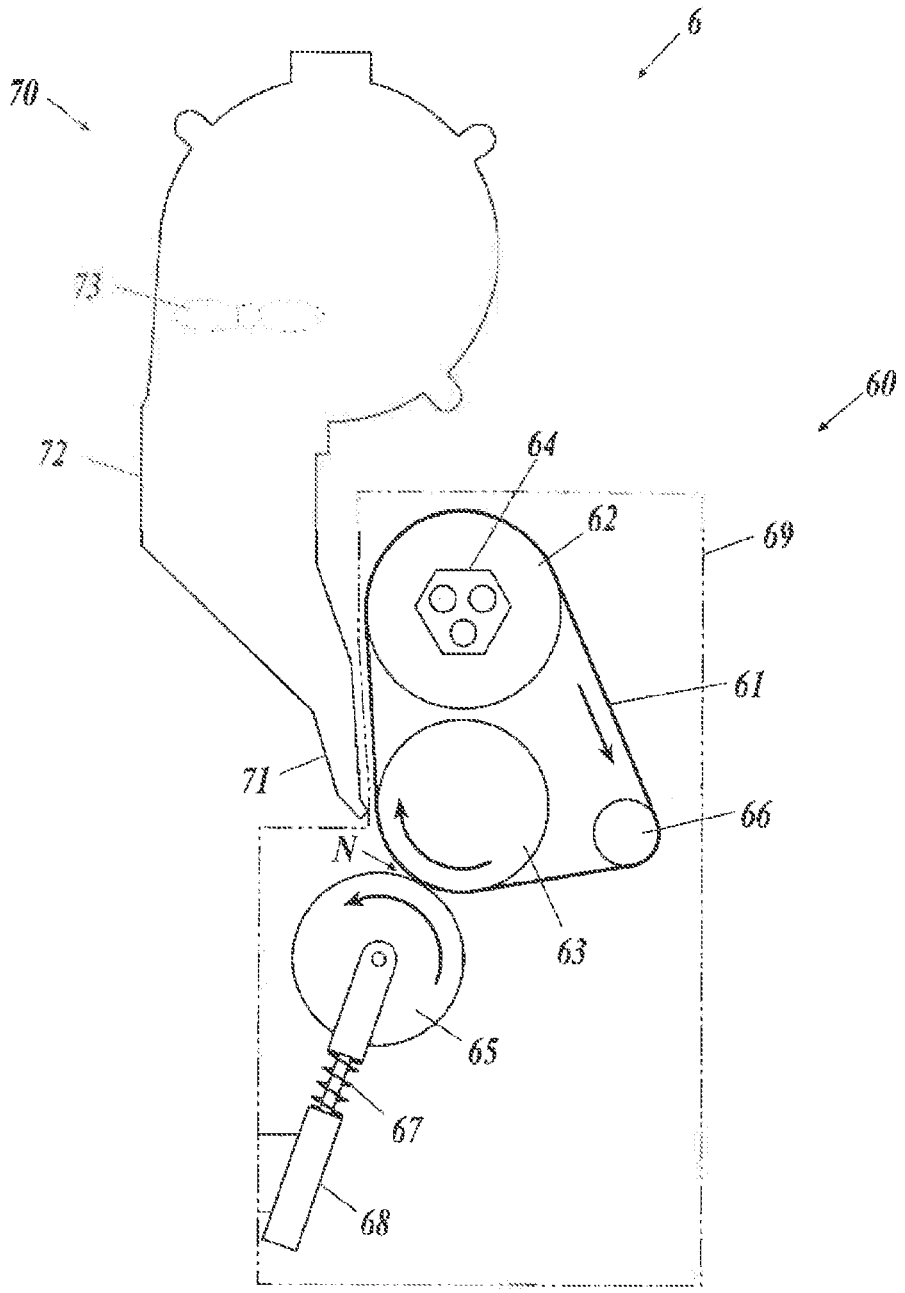
FIG. 3 is a cross-sectional view showing the configuration of the fixing device.

The fixing device 6 includes, as shown in FIGS. 2 and 3, a fixing unit 60, an air blowing unit 70, a movement unit 90 and a support casing 69 in which the fixing unit 60 is housed.

[Fixing Device: Fixing Unit]

The fixing unit 60 includes, as shown in FIG. 3, a fixing belt 61, a heating roller 62, a fixing roller 63, heating members 64, a pressure roller 65, a tension roller 66 and the support casing 69 which supports these components.

The fixing roller 63, the pressure roller 65 and the fixing belt 61 form a nip part N. The fixing belt 61 is stretched around the heating roller 62, the fixing roller 63 and the tension roller 66. The heating roller 62 has the built-in heating members 64 and heats the fixing belt 61.

The fixing belt 61 and the pressure roller 65 function as sandwiching members between which paper P is sandwiched in a state in which the surfaces of the fixing belt 61 and the pressure roller 65 directly contact the paper P.

Although the present invention is also applicable to an image forming apparatus provided with a fixing device (heat roller system) in which a fixing roller 63 has built-in heating members without a fixing belt 61, in the embodiment, a fixing device using a heat belt system is described as an example.

The fixing belt 61 contacts the paper P to which color toner images are secondary-transferred so as to heat the paper P at a fixing temperature. The fixing temperature herein is a temperature at which a necessary amount of heat for melting the toners can be supplied at the time when the paper P passes through the nip part N. The fixing temperature differs depending on, for example, the type of paper P on which image formation is performed. The fixing belt 61 has a structure in which an elastic layer made of silicone rubber or the like and a surface-releasable layer made of fluorine-based resin such as PFA (perfluoroalkoxy alkane) or PTFE (polytetrafluoroethylene) are stacked in order on the outer circumferential face of a heat-resistant film substrate made of polyimide or the like.

The fixing belt 61 is stretched around the heating roller 62, the fixing roller 63 and the tension roller 66 in a state in which a certain tension is generated by the tension roller 66 which is disposed next to the fixing roller 63. Consequently, the fixing belt 61 firmly contacts parts (partial regions) of the outer circumferential faces of the heating roller 62 and the fixing roller 63. At least the outer circumferential face of the tension roller 66 is made of a material having certain levels of heat resistance and releasability.

The heating roller 62 heats the fixing belt 61 in such a way that the paper P is heated by the fixing belt 61 at a predetermined temperature, namely, that the temperature of the fixing belt 61 becomes the fixing temperature. The heating roller 62 has a structure in which a resin layer made of PTFE or the like is formed on the outer circumferential face of a cylindrical cored bar made of aluminum or the like.

The heating roller 62 has, as a heat source, the built-in heating members 64 composed of halogen heater bulbs or the like arranged at a plurality of points in the axial direction of the heating roller 62. The heating members 64 heat their respective corresponding points of the heating roller 62 in the axial direction of the heating roller 62, and accordingly heat their respective corresponding points of the fixing belt 61 in the width direction of the fixing belt 61. The control unit 80 controls output of the heating members 64. The fixing belt 61 may be heated by electromagnetic induction heating (IH).

Near the nip part P, temperature sensors (not shown) for temperature control are disposed. The temperature sensors detect temperatures of the fixing belt 61 near the nip part N. The temperature sensors are arranged in the paper width direction of paper P. The control unit 80 controls output of the heating members 64, which are at positions corresponding to the individual temperature sensors, in such a way that the temperatures measured (detected) by the individual temperature sensors match preset temperatures for the individual temperature sensors, the preset temperatures being required for the fixation.

The fixing roller 63 has a rotary motor 63*a* as a driving source for rotation. The control unit 80 controls drive (ON/OFF of rotation, the number of rotations, etc.) of the rotary motor 63*a*.

The fixing roller 63 has a structure in which an elastic layer made of silicone rubber or the like is formed on the outer circumferential face of a cylindrical cored bar made of iron or the like. Additionally, a surface-releasable layer made of fluorine-based resin such as PFA or PTFE may be formed on the outer circumferential face of the elastic layer.

The pressure roller 65 has a structure in which an elastic layer made of silicone rubber or the like is formed on the outer circumferential face of a cylindrical cored bar made of iron or the like, and a surface-releasable layer made of fluorine-based resin such as PFA or PTFE is formed on the outer circumferential face of the elastic layer.

The pressure roller 65, the heating roller 62, the fixing roller 63 and the tension roller 66 are supported by the support casing 69 to be rotatable in a state in which their rotational axes are parallel to each other. The pressure roller 65 is also supported thereby in a state in which the pressure roller 65 is pressed toward the fixing roller 63 by an elastic body 67. Consequently, the nip part N parallel to the rotational axes of the pressure roller 65 and the fixing roller 63 is formed by the pressure roller 65 and the fixing roller 63 pressing against each other. The pressure roller 65 corotates with the fixing roller 63 by receiving torque from the fixing roller 63 by pressure contact with the fixing roller 63, thereby performing a rotary drive action.

The pressure roller 65 is provided with an actuator 68. The actuator 68 is composed of a solenoid or the like and separates the pressure roller 65 from the fixing roller 63 against the elastic body 67. The control unit 80 controls the actuator 68.

The fixing roller 63 and the pressure roller 65 may have built-in heating members, such as halogen heater bulbs.

The support casing 69 is supported by the machine casing of the image forming apparatus 1 via not-shown slide guides in such a way as to be movable along a direction (the paper width direction which is parallel to the rotational axes of the rollers 63 to 66) which is along the surface of paper P passing through the nip part N, and is at right angles to the conveyance direction of the paper P.

The support casing 69 is provided with the movement unit 90 which moves the support casing 69 along the paper width direction as needed. The movement unit 90 includes a movement motor 91 and an action conversion mechanism which converts torque of the movement motor 91 into linear force (linear motion) along the paper width direction so as to apply the linear force to the support casing 69. As the action conversion mechanism, a pinion-rack mechanism, a ball screw mechanism or the like can be used. As the movement motor 91, a motor which can act with an arbitrary action amount under the control of the control unit 80, such as a stepping motor or a servo motor, can be used. Use of a motor which performs linear motion, such as a linear motor, makes the action conversion mechanism unnecessary.

[Fixing Device: Air Blowing Unit]

The air blowing unit 70 includes, as shown in FIG. 3, a duct 72 provided with an air blowing port 71 facing the nip part N, and a fan 73 for blowing air through the air blowing port 71.

The fan 73 is disposed inside the duct 72, and takes the outside air into the duct 72 and blows the air through the air blowing port 71 by rotating in a predetermined direction with a not-shown motor. The air is blown from the air blowing port 71 to the nip part P from the downstream side in the conveyance direction of paper P.

Consequently, the paper P sticking to the fixing belt 61 at the nip part N can be separated therefrom.

As described above, the support casing 69 moves along the paper width direction. The air blowing port 71 is sufficiently wider than the fixing belt 61 so that the air can be blown to the nip part N from the air blowing port 71 no matter where the nip part N is located in the movable area of the support casing 69.

The air blowing unit 70 may be attached to the support casing 69 so as to move together with the fixing unit 60.

[Control on Fixing Device in Image Formation]

Control on the fixing device 6 in image formation performed by the control unit 80 is described with reference to FIGS. 4 and 5A to 5D. This control is performed by the CPU 81 executing a control program stored in the ROM 82.

When the end parts of paper P in the paper width direction always pass through the same points on the surfaces of the fixing belt 61 and the pressure roller 65, it damages the surfaces thereof with scratches and/or indentations (traces), and these scratches and/or indentations make the surfaces rough, which may cause degradation in image quality of formed images. In order to avoid such a situation, when a certain execution condition is satisfied, the control unit 80 performs control under which the actuator 68 of the fixing unit 60 evacuates the pressure roller 65 to so as release a sandwiching pressure at the nip part N and thereafter the movement unit 90 moves the fixing unit 60 along the paper width direction. Hereinafter, this control is referred to as fixing unit movement control (first control).

That is, in the case where paper P is continuous like rolled paper without gaps therein, the actuator 68 forms a space between the pressure roller 65 and the fixing belt 61 so as to release the paper P sandwiched therebetween, and thereafter the movement unit 90 moves the support casing 69 containing the fixing unit 60 along the paper width direction, whereby the positions of the end parts of the paper P in the paper width direction in relation to the fixing belt 61 and the pressure roller 65 change.

The control unit 80 sets one of (1) to (3) below as the execution condition for the fixing unit movement control. The control unit 80 can also set two of them, (1) and (3) or (2) and (3) as the predetermined exaction condition.

(1) The amount (paper passing amount) of paper P passing through the nip part N reaches a predetermined paper passing amount.

(2) The length of time (paper passing time length) taken for paper P to pass through the nip part N reaches a predetermined paper passing time length.

(3) A stopping factor for the conveyance unit 50 to stop conveying paper P occurs.

In the case where (1) is set as the execution condition, each time (1) is satisfied, the fixing unit movement control is performed. In the case where (2) is set as the execution condition, each time (2) is satisfied, the fixing unit movement control is performed. In the case where (3) is set as the execution condition, when (3) is satisfied, namely, while the conveyance unit 50 stops conveying paper P because of the stopping factor, the fixing unit movement control is performed.

In the case where (1) is set as the execution condition, the control unit 80 adds up paper passing amounts of paper P passing through the nip part N from output of a detection sensor (for example, an encoder) which detects a rotation amount of a motor or roller. The motor or roller, the rotation amount of which is detected by the detection sensor is any of the motors 511, 522, 531 and 63*a*, each of which acts with an action amount having a relationship with the paper passing amount of paper P passing though the nip part N, and the rollers 512, 521, 532, 63, 65, 47*b* and 49, which are disposed on the conveyance path of paper P and rotate when the paper P is conveyed. When determining that the added-up value of paper passing amounts reaches a predetermined value, the control unit 80 resets the added-up value and performs the fixing unit movement control. Thus, the control unit 80 repeats calculation of the paper passing amount and determination whether or not the calculated paper passing amount reaches its predetermined value so as to perform the fixing unit movement control.

In the case where (2) is set as the execution condition, the control unit 80 has a timer unit and adds up paper passing time lengths during which one of the motors 511, 522, 531 and 63*a*, which are driven when the paper P is conveyed, is driven. When determining that the added-up value of paper passing time lengths reaches a predetermined value, the control unit 80 resets the added-up value and performs the fixing unit movement control. Thus, the control unit 80 repeats calculation of the paper passing time length and determination whether or not the calculated paper passing time length reaches its predetermined value so as to perform the fixing unit movement control.

In the case where (1) or (2) is set as the execution condition, an interval between execution of the fixing unit movement control is increased or decreased depending on the thickness information, which indicates the thickness, and the hardness information, which indicates the hardness, about paper P, obtained from the operation display unit 22, namely, depending on which of "thick paper", "plain paper" and "thin paper", the paper P is, and which of "hard", "medium" and "soft", the paper P is.

That is, the thicker the paper P is, the more easily scratches and/or indentations are generated on the fixing belt 61 and the pressure roller 65, and therefore it is necessary to make the interval shorter.

For example, the predetermined value for each of the paper passing amount and the paper passing time length in the case where paper P is "plain paper" in terms of thickness is taken as a standard value, and in the case where paper P is "thick paper" in terms of thickness, the interval is shortened by multiplying the standard value by a predetermined coefficient a ($0<a<1$), whereas in the case where paper P is "thin paper" in terms of thickness, the interval is extended by multiplying the standard value by a predetermined coefficient b ($b>1$).

Also, the predetermined value for each of the paper passing amount and the paper passing time length in the case where paper P is "medium" in terms of hardness is taken as a standard value, and in the case where paper P is "hard" in terms of hardness, the interval is shortened by multiplying the standard value by a predetermined coefficient c ($0<c<1$), whereas in the case where paper P is "soft" in terms of hardness, the interval is extended by multiplying the standard value by a predetermined coefficient d ($d>1$).

In the case where both the thickness information and the hardness information about paper P are obtained, the interval of execution of the fixing unit movement control is determined by, as needed, multiplying the standard value by the coefficients a, b, c and/or d according to the contents of the thickness information and the hardness information.

The stopping factor(s) for the conveyance unit 50 in (3) is described.

The control unit 80 performs control (second control) under which the motors 511, 522 and 531 of the conveyance unit 50 temporarily stop until the stopping factor is solved. Examples of the stopping factor include (i) completion of image formation (image fixation included) in accordance with accumulated jobs based on image data obtained by the image reading unit 10 reading images formed on a document(s) or jobs based on image data input from the outside, (ii) a paper jam, (iii) execution of idling control on the fixing unit 60 and (iv) execution of image quality stabilization control.

The jobs based on image data are monitored by the CPU 81 of the control unit 80, so that completion thereof can be detected.

The paper jam can be detected from increase in torque values of the motors 511, 522 and 531 or decrease in speeds of the motors 511, 522 and 531.

The idling control on the fixing unit 60 is control to increase output of the heating members 64 to raise the heating temperature up to a target temperature when certain decrease in the temperature is detected by a not-shown detection sensor for a heating temperature provided for the fixing unit 60. Hence, execution of the idling control on the fixing unit 60 can be detected from output of the detection sensor for a heating temperature provided for the fixing unit 60.

The image quality stabilization control is control, in the image forming unit 40, to develop latent images on the photosensitive drums 43Y, 43M, 43C and 43K in accordance with a predetermined pattern and obtain correction data for correcting image densities and/or image gradations from a detection result obtained by optical sensors, which are provided for the photosensitive drums 43Y, 43M, 43C and 43K, receiving light reflected by the photosensitive drums 43Y, 43M, 43C and 43K. While this control is performed, the conveyance unit 50 stops conveying paper P.

The image quality stabilization control is performed, for example, after a main power source is turn on, before image formation is performed on paper P or between image formation and image formation. The control unit 80 recognizes timing of execution of the image quality stabilization control.

The control unit 80 may perform the fixing unit movement control when any of the above described four stopping factors occurs, or may pick up one or more stopping factors among the four stopping factors and perform the fixing unit movement control when any of the picked-up stopping factors occurs. Further, the control unit 80 may perform the fixing unit movement control each time a stopping factor occurs or every arbitrary times a stopping factor occurs.

In the case where (1) and (3) or (2) and (3) are set as the execution condition, the control unit 80 monitors both occurrence of the stopping factor (i.e. (3)) and the added-up value of paper passing amounts of paper P passing through the nip part N (i.e. (1)) or the added-up value of paper passing time lengths taken for paper P to pass through the nip part N (i.e. (2)), and when either (3) or (1)/(2) is satisfied, the control unit 80 performs the fixing unit movement control. Even when the control unit 80 performs the fixing unit movement control due to the occurrence of the stopping factor, the control unit 80 resets the added-up value of paper passing amounts or the added-up value of paper passing time lengths and restarts counting.

The control unit 80 may automatically set only one of (1); (2); (3); (1) and (3); and (2) and (3) as the execution condition due to specifications of the image forming apparatus 1 or may set one of (1); (2); (3); (1) and (3); and (2) and (3) selected by a user using the operation unit 22 of the operation display unit 20.

In order to perform the fixing unit movement control due to the added-up value of paper passing amounts or the added-up value of paper passing time lengths reaching its predetermined value, the control unit 80 performs the control under which the conveyance unit 50 stops conveying paper P.

Instead of the control under which the conveyance unit 50 stops conveying paper P, the control unit 80 may perform control (third control) under which the conveyance unit 50 conveys paper P at a conveyance speed sufficiently lower than a standard conveyance speed (conveyance speed while the fixing unit movement control is not performed).

The movement unit 90 moves the fixing unit 60 toward one side (forward, for example) in the paper width direction, and when one end part of the fixing belt 61 and one end part of the pressure roller 65 in the paper width direction approach one end part of paper P in the paper width direction, the movement unit 90 moves the fixing unit 60 toward the other (opposite) side (backward, for example) in the paper width direction. It is preferable that a movement stroke of the fixing unit 60 differ (i.e. take different values) between the movement toward one side and the movement toward the other side. This can reduce the frequency with which the position of each end part of paper P in the paper width direction in relation to the fixing belt 61 and the pressure roller 65 becomes the same by the movement toward one side and the movement toward the other side.

[Image Forming Processing]

Figure 4:
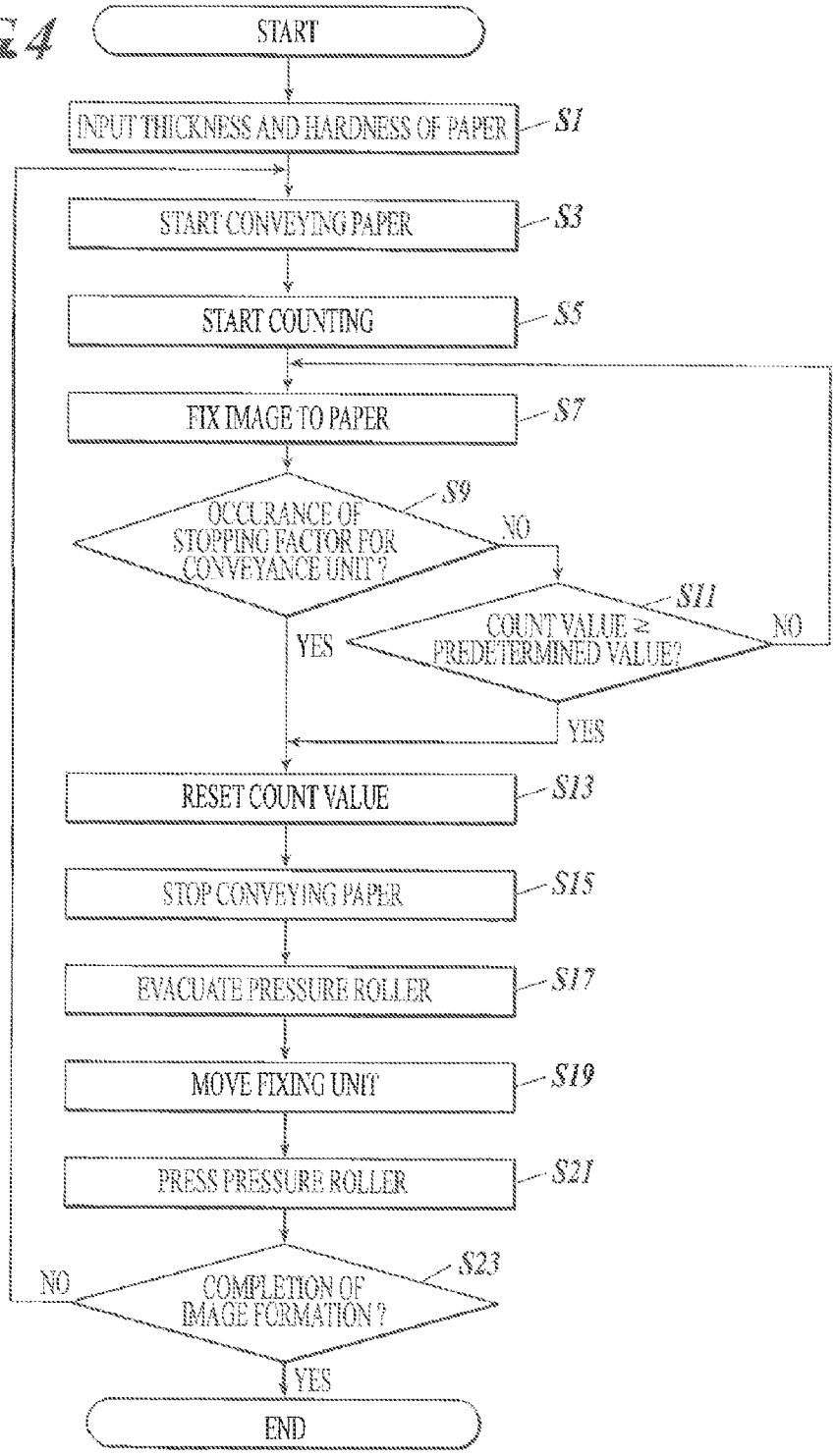
FIG. 4 is a flowchart of fixing unit movement control performed by a control unit.

Next, image forming processing is described with reference to the flowchart of FIG. 4 and the illustrations of FIGS. 5A to 5D. The image forming processing is performed before the above described control on the fixing device 6 starts. Herein, the above described (1) and (3) or (2) and (3) are set as the execution condition for the fixing unit movement control.

First, when the thickness information and the hardness information about paper P are input from the operation unit 22 of the operation display unit 20, the control unit 80 identifies the thickness category and the hardness category of the paper P and stores the identified categories in the storage unit disposed in the control unit 80 (Step S1).

In this case, the execution condition for the fixing unit movement control is related to the predetermined value for the paper passing amount or related to the predetermined value for the paper passing time length. The predetermined value for the paper passing amount or the predetermined value for the paper passing time length changes on the basis of the thickness and/or the hardness of the paper P. The predetermined value for the paper passing amount or the predetermined value for the paper passing time length is obtained by, as needed, multiplying its standard value (the predetermined value for the paper passing amount or the predetermined value for the paper passing time length) by the coefficients a, b, c and/or d according to the thickness category and the hardness category of the paper P.

When obtaining image data obtained by the image reading unit 10 or image data input from the outside, the control unit 80 makes the image forming unit 40 start the image forming processing and also stops the conveyance unit 50 from conveying the paper P (Step S3).

The control unit 80 starts counting the paper passing amount if the execution condition for the fixing unit movement control is related to the predetermined value for the paper passing amount, or starts counting the paper passing time length if the execution condition for the fixing unit movement control is related to the predetermined value for the paper passing time length (Step S5).

When a color toner image is transferred to the paper P in the image forming unit 40, the image is fixed by heat and pressure to the paper P by the fixing roller 63, the pressure roller 65 and the fixing belt 61 while the paper P having the image thereon passes through the fixing unit 60 (Step S7). At the time, air is blown from the air blowing unit 70 to the paper P passing through the nip part N so as to prevent the paper P from sticking to the fixing belt 61.

The control unit 80 determines whether or not any stopping factor for the conveyance unit 50 occurs while the conveying unit 50 conveys the paper P (Step S9). That is, the control unit 80 determines whether or not any of the stopping factors, job completion, a paper jam, execution of idling control on the fixing unit 60 and execution of image quality stabilization control, occurs. When determining that at least one of the stopping factors for the conveyance unit 50 occurs (Step S9; YES), the control unit 80 proceeds to Step S13. On the other hand, when determining that none of the stopping factors occurs (Step S9; NO), the control unit 80 determines whether or not the count value of the paper passing amount or the paper passing time length reaches its predetermined value (Step S11).

When determining that the count value of the paper passing amount or the paper passing time length does not reach its predetermined value yet (Step S11; NO), the control unit 80 returns to Step S7 so that the fixing unit 60 continues image fixation to the paper P. On the other hand, when determining that the count value of the paper passing amount or the paper passing time length reaches its predetermined value (Step S11; YES), the control unit 80 proceeds to Step S13.

Figure 5A:
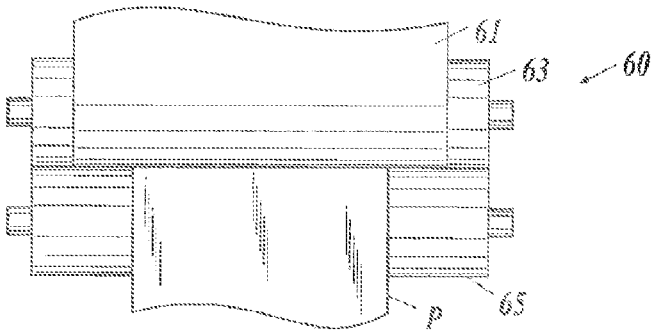
FIG. 5A is an illustration showing a step of the fixing unit movement control.

At Step S13, the control unit 80 resets the count value (Step S13) and stops the conveyance unit 50 from conveying the paper P (Step S15, see FIG. 5A).

Figure 5B:
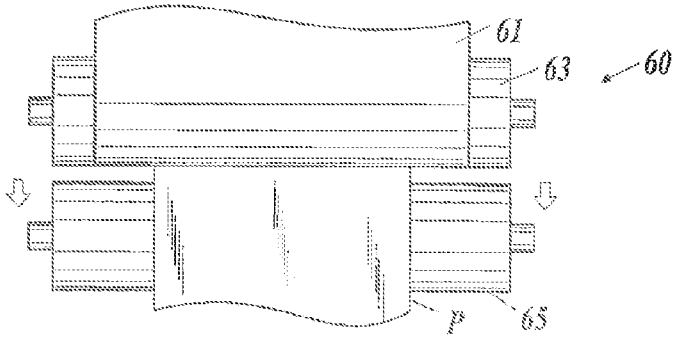
FIG. 5B is an illustration showing a step of the fixing unit movement control following the step shown in FIG. 5A.

Next, the control unit 80 drives the actuator 68 so that the actuator 65 evacuates the pressure roller 65 in an evacuation direction in which the pressure roller 65 separates from the fixing roller 63, thereby releasing the sandwiching pressure at the nip part N (Step S17, see FIG. 5B).

Figure 5C:
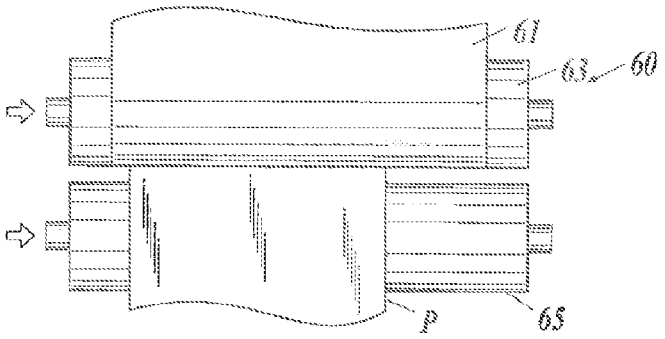
FIG. 5C is an illustration showing a step of the fixing unit movement control following the step shown in FIG. 5B.

Then, the control unit 80 makes the movement unit 90 move the fixing unit 60 a predetermined distance along the paper width direction (Step S19, see FIG. 5C).

Figure 5D:
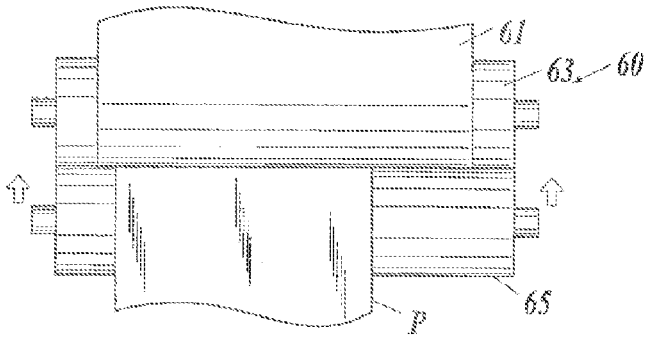
FIG. 5D is an illustration showing a step of the fixing unit movement control following the step shown in FIG. 5C.

The control unit 80 makes the actuator 68 release the bias toward the evacuation direction for the pressure roller 65, thereby returning the nip part P to the sandwiching state (Step S21, see FIG. 5D).

By a series of these steps of the fixing unit movement control, the fixing unit 60 moves a predetermined distance along the paper width direction with respect to the paper P, so that the paper P can avoid being heated and pressed at the same position.

When determining that all of the jobs of image formation are completed (Step S23; YES), the control unit 80 ends the processing. On the other hand, when determining that not all of the jobs of image formation are completed yet (Step S23; NO), the control unit 80 returns to Step S3 so as to make the conveyance unit 50 restart conveying the paper P.

[Technical Effects of First Embodiment]

In the image forming apparatus 1, the control unit 80 performs the control under which the actuator 68 releases the sandwiching pressure made by the fixing belt 61 and the pressure roller 65 and thereafter the movement unit 90 moves the components of the fixing unit 60. Consequently, even in the case of continuous paper P such as rolled paper, the paper P is not dragged by the fixing belt 61 or the pressure roller 65, and accordingly only the components of the fixing unit 60 can be moved smoothly. Therefore, even in the case of continuous paper P, generation of scratches and indentations on the surfaces of the fixing belt 61 and the pressure roller 65 can be effectively reduced as well as paper P can be protected from being dragged by the fixing belt 61 or the pressure roller 65.

Further, in the image forming apparatus 1, the control unit 80 performs the control under which the conveyance unit 50 stops conveying paper P so as to perform the control under which the movement unit 90 moves the components of the fixing unit 60. Consequently, influence of sliding of the components of the fixing unit 60 on paper P caused by the movement of the components of the fixing unit 60 can be reduced.

The control unit 80 may perform the control under which the conveyance unit 50 conveys paper P to the fixing unit 60 at a lower speed so as to perform the control under which the movement unit 90 moves the components of the fixing unit 60. Consequently, in addition to the influence of sliding of the components of the fixing unit 60 on paper P caused by the movement of the components of the fixing unit 60, delay in the paper conveyance can be reduced.

Further, in the image forming apparatus 1, the control unit 80 periodically performs the fixing unit movement control on the basis of the paper passing amount of paper P passing through the nip part N or the paper passing time length taken for paper P to pass through the nip part N. Consequently, generation of scratches and indentations on the surfaces of the fixing belt 61 and the pressure roller 65 can be effectively reduced.

Further, the thicker the paper P is, the more frequently the control unit 80 performs the fixing unit movement control. Consequently, generation of scratches and indentations on the surfaces of the fixing belt 61 and the pressure roller 65 can be effectively reduced even when paper P is thick paper, with which scratches and indentations are easily generated on the surfaces of rollers (fixing belt included).

Similarly, the harder the paper P is, the more frequently the control unit 80 performs the fixing unit movement control. Consequently, generation of scratches and indentations on the surfaces of the fixing belt 61 and the pressure roller 65 can be effectively reduced even when paper P is hard paper, with which scratches and indentations are easily generated on the surfaces of rollers (fixing belt included).

Further, in the case where the control unit 80 performs the fixing unit movement control when a stopping factor for the conveyance unit 50 to stop conveying paper P occurs, it is unnecessary for the control unit 80 to stop the conveyance unit 50 from conveying paper P only for the fixing unit movement control. Consequently, the frequency with which conveyance of paper P stops can be reduced, and accordingly efficient image formation can be performed.

Second Embodiment

Figure 6:
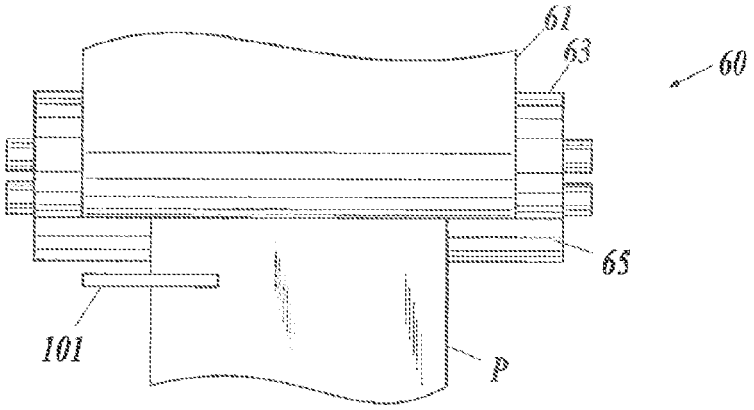
FIG. 6 is a plan view showing a paper sensor disposed near a nip part.

Ina second embodiment of the present invention, the image forming apparatus 1 is, as shown in FIG. 6, provided with a paper sensor 101 near the nip part N of the fixing unit 60. The paper sensor 101 detects the position (end part position) of one end part of paper P in the paper width direction in relation to the fixing belt 61 and the pressure roller 65. The control unit 80 performs control to adjust the movement amount of the fixing unit 60 in the fixing unit movement control on the basis of the end part position of paper P detected by the paper sensor 101 (hereinafter, referred to as passing point adjustment control). Except that, the configuration of the image forming apparatus 1 of the second embodiment is the same as that of the image forming apparatus 1 of the first embodiment, and therefore description thereof is omitted.

The paper sensor 101 is a line sensor which is composed of a plurality of light receiving elements arranged along the paper width direction and receives light emitted from a not-shown light source arranged in such a way as to face the light receiving elements with paper P in between. With this configuration, the end part position of paper P can be detected on the basis of difference between the amount of light detected by light receiving elements covered with the paper P and the amount of light detected by light receiving elements uncovered with the paper P.

The paper sensor 101 is attached to the support casing 69 for the fixing unit 60 and moves by the movement unit 90 along the paper width direction together with the components of the fixing unit 60 when the fixing unit movement control is performed.

Next, the passing point adjustment control performed by the control unit 80 is described.

In the passing point adjustment control, while the convening unit 50 conveys paper P, the control unit 80 repeatedly detects the end part position of the paper P with the paper sensor 101 at very short intervals and stores a history of change of the end part position in the storage unit.

Then, from the history of change of the end part position of the paper P, the control unit 80 calculates the most-frequently-detected end part position of the paper P between the last fixing unit movement control and the coming (next) fixing unit movement control.

The end part position of paper P may be expressed in units of bands into which a range in the paper width direction passable for the paper P is equally divided, thereby being expressed with a certain latitude.

Then, the control unit 80 performs the fixing unit movement control, so that the movement unit 90 moves the fixing unit 60 a predetermined movement amount (distance) along the paper width direction, and the control unit 80 obtains the end part position of the paper P after the movement from the paper sensor 101. Then, the control unit 80 determines whether or not the end part position of the paper P after the movement and the most-frequently-detected end part position of the paper P match. When determining that the end part position of the paper P after the movement and the most-frequently-detected end part position of the paper P match, the control unit 80 makes the movement unit 90 additionally move the fixing unit 60 along the paper width direction. The movement amount at this time may be the same as or different from the predetermined movement amount.

Figure 7A:
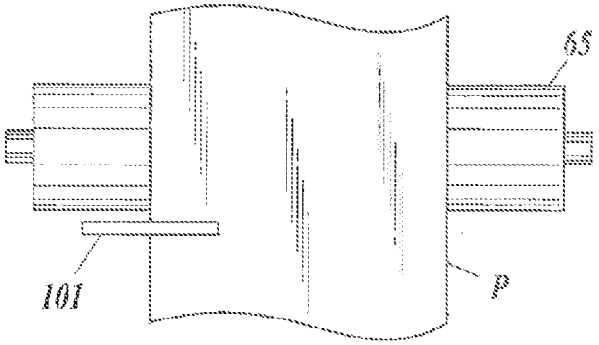
FIG. 7A is an illustration showing a state of the fixing unit before execution of the fixing unit movement control.

FIG. 7A shows a state of the fixing unit 60 immediately before the fixing unit movement control. (In FIGS. 7A and 7B, the fixing belt 61 and the fixing roller 63 are not shown.)

As described above, paper P is controlled by the guides of the conveyance mechanism 52 so that the paper P is not displaced in the paper width direction. Hence, paper P basically keeps its predetermined position in the paper width direction, but may be displaced from the predetermined position or wind by various factors.

Figure 7B:
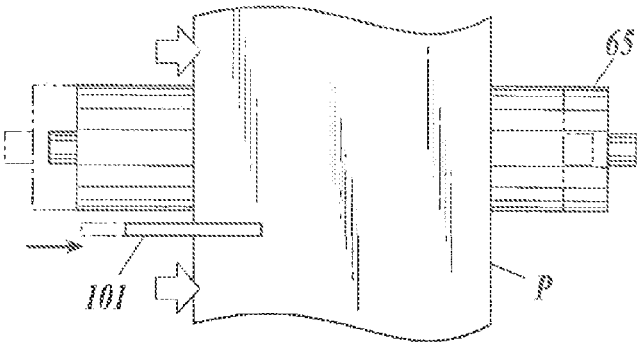
FIG. 7B is an illustration showing a state of the fixing unit after execution of the fixing unit movement control by which paper is moved together with the fixing unit.

Then, as shown in FIG. 7B, by execution of the fixing unit movement control, paper P displaced from the predetermined position may return to the predetermined position, or paper P may be moved together with the components of the fixing unit 60. In such a case, the end part position of the paper P after the fixing unit movement control and the most-frequently-detected end part position of the paper P may match.

In this case too, the movement unit 90 additionally moves the fixing unit 60 along the paper width direction, whereby the above match can be broken up.

In the second embodiment, the paper sensor 101 is attached to the support member 69 and accordingly moves along the paper width direction together with the fixing unit 60 when the fixing unit movement control is performed. The paper sensor 101 may be fixed to the machine casing of the image forming apparatus 1 instead of being attached to the support casing 69 and accordingly does not move when the fixing unit movement control is performed.

In this case, it is necessary to take into account the distance which the fixing belt 61 and the pressure roller 65 moves by the fixing unit movement control so as to calculate the end part position of the paper P after the fixing unit movement control in relation to the fixing belt 61 and the pressure roller 65.

Further, the paper sensor 101 may be disposed on the upstream side or the downstream side in the conveyance direction as long as the paper sensor 101 is disposed near the nip part N.

Further, the paper sensor 101 may be any type of detecting element as long as it can detect the end part position of paper P, and usable examples thereof include but are not limited to the above described line sensor, a two-dimensional light receiving sensor and a contact sensor.

As described above, the control unit 80 obtains, on the basis of detection by the paper sensor 101, the history of change of the end part position of paper P in the paper width direction since the last movement of the fixing unit 60 and controls the movement unit 90 in such a way that the movement unit 90 moves the fixing unit 60, avoiding the point (on each of the fixing belt 61 and the pressure roller 65) where the end part of the paper P has most frequently passed. Consequently, in the case where the position of the paper P in the paper width direction is not stable or in the case where the paper P is conveyed with its position displaced from its normal position, the following situation can be avoided; execution of the fixing unit movement control put the end part of the paper P at the point where the end part of the paper P has most frequently passed. Consequently, generation of scratches and indentations on the surfaces of the sandwiching members can be effectively reduced.

[Others]

In the fixing unit movement control of the embodiments, the movement unit 90 moves the entire fixing unit 60. However, this is not a limitation. The movement unit 90 needs to move at least the fixing belt 61 and the pressure roller 65 which form the nip part N.

Further, the paper feed device 51 may feed not rolled paper but another type of continuous paper such as continuous form paper (i.e. continuous stationary) which is folded at regular intervals and accordingly is composed of stacked pieces. In this case, it is desired that the paper ejection device 53 can stack, not roll up, the ejected pieces of the continuous form paper.

Further, paper to use may be made of a seal material having an adhesive face to which glue is applied and which is covered with a sheet. In this case, execution of the fixing unit movement control can: effectively prevent the overflowed glue from the seal material from concentratedly adhering to a certain point on each of the fixing belt 61 and the pressure roller 65 (i.e. can spread glue adhesion points on the surfaces of the sandwiching members) in the fixing unit 60; reduce possibility of soiling paper P with the glue; and form clean images.

Further, execution of both the fixing unit movement control and the passing point adjustment control can more effectively prevent the overflowed glue from the seal material from concentratedly adhering to a certain point on each of the fixing belt 61 and the pressure roller 65 in the fixing unit 60.

This application is based upon and claims the benefit of priority under 35 USC 119 of Japanese Patent Application No. 2013-184091 filed on Sep. 5, 2013, the entire disclosure of which, including the specification, claims, drawings and abstract, is incorporated herein by reference in its entirety.

What is claimed is:

1. An image forming apparatus comprising:

a paper feed unit which feeds paper;

an image forming unit which forms a toner image on the paper;

a fixing unit including sandwiching members between which the paper is sandwiched and which form a nip part, the fixing unit fixing the toner image to the paper at the nip part;

a conveyance unit which conveys the paper along a conveyance path which passes through the image forming unit and the fixing unit;

a control unit which controls an action of the image forming apparatus;

a movement unit which moves the sandwiching members along a paper width direction which is at right angles to a conveyance direction of the paper; and an actuator which releases a sandwiching pressure made by the sandwiching members, wherein when an execution condition is satisfied, the control unit performs first control under which the actuator releases the sandwiching pressure and thereafter the movement unit moves the sandwiching members along the paper width direction.

2. The image forming apparatus according to claim 1, wherein the control unit performs second control under which the conveyance unit stops conveying the paper to the fixing unit so as to perform the first control.

3. The image forming apparatus according to claim 1, wherein the control unit performs third control under which the conveyance unit conveys the paper to the fixing unit at a conveyance speed lower than a standard conveyance speed so as to perform the first control.

4. The image forming apparatus according to claim 1, wherein the execution condition is that an amount of the paper passing through the nip part reaches a predetermined value, and each time the execution condition is satisfied, the control unit performs the first control.

5. The image forming apparatus according to claim 1, wherein the execution condition is that a length of time taken for the paper to pass through the nip part reaches a predetermined value, and each time the execution condition is satisfied, the control unit performs the first control.

6. The image forming apparatus according to claim 4 further comprising a first obtaining unit which obtains thickness information indicating thickness of the paper, wherein as the thickness indicated by the thickness information increases, the control unit increases a frequency of the first control.

7. The image forming apparatus according to claim 4 further comprising a second obtaining unit which obtains hardness information indicating hardness of the paper, wherein as the hardness indicated by the hardness information increases, the control unit increases a frequency of the first control.

8. The image forming apparatus according to claim 1, wherein the execution condition is that a stopping factor for the conveyance unit to stop conveying the paper occurs, and when the execution condition is satisfied, the control unit performs the first condition.

9. The image forming apparatus according to claim 1 further comprising a paper sensor which detects a position of an end part of the paper in the paper width direction in relation to the sandwiching members, the paper passing through the fixing unit, wherein the control unit stores a history of the position of the end part detected by the paper sensor in a storage unit since the first control performed last time, and performs the first control again in such a way as to avoid a point on each of the sandwiching members, the point where the end part of the paper has most frequently passed according to the history.

* * * * *